US009127882B2

(12) United States Patent
Jenkins et al.

(10) Patent No.: US 9,127,882 B2
(45) **Date of Patent: *Sep. 8, 2015**

(54) DRYING METHOD

(75) Inventors: Stephen Derek Jenkins, Cleveland (GB); Frazer John Kennedy, South Yorkshire (GB); Stephen Martin Burkinshaw, Yorkshire (GB)

(73) Assignee: Xeros Limited, Rotherham (GB)

( * ) Notice: Subject to any disclaimer, the term of this patent is extended or adjusted under 35 U.S.C. 154(b) by 189 days.

This patent is subject to a terminal disclaimer.

(21) Appl. No.: 13/980,325

(22) PCT Filed: Jan. 19, 2012

(86) PCT No.: PCT/GB2012/050121

§ 371 (c)(1),
(2), (4) Date: Jul. 18, 2013

(87) PCT Pub. No.: WO2012/098408

PCT Pub. Date: Jul. 26, 2012

(65) Prior Publication Data

US 2013/0305560 A1 Nov. 21, 2013

(30) Foreign Application Priority Data

Jan. 19, 2011 (GB) ..... 1100918.0

(51) Int. Cl.
*F26B 3/02* (2006.01)
*D06F 58/28* (2006.01)
(Continued)

(52) U.S. Cl.
CPC . *F26B 3/02* (2013.01); *D06F 58/02* (2013.01); *D06F 58/28* (2013.01); *F26B 3/205* (2013.01); *D06F 2058/2877* (2013.01)

(58) Field of Classification Search
CPC ..... F26B 3/00; F26B 3/02; D06F 58/00; D06F 5/20; D06L 1/00
USPC ..... 34/380, 381, 413, 497; 68/19, 20; 510/515
See application file for complete search history.

(56) References Cited

U.S. PATENT DOCUMENTS 2,970,464 A 2/1961 Toma
3,321,843 A 5/1967 Taran et al.

(Continued)

FOREIGN PATENT DOCUMENTS

CA 1284407 C 5/1991
CN 1723008 A 1/2006

(Continued)

OTHER PUBLICATIONS

U.S. Appl. No. 14/427,046, Xeros Ltd.

(Continued)

*Primary Examiner* — Stephen M Gravini
(74) *Attorney, Agent, or Firm* — Clark & Elbing LLP

(57) ABSTRACT

The invention provides a method for the drying of a wet substrate, the method comprising treating the substrate with a solid particulate material at ambient or elevated temperature, the treatment being carried out in an apparatus comprising a drum comprising perforated side walls, wherein the drum comprising perforated side walls is rotated so as to facilitate increased mechanical action between the substrate and the particulate material. Preferably, the drum comprising perforated side walls has a capacity of between 5 and 50 liters for each kg of fabric in the load and is rotated at a speed which generates G forces in the range of from 0.05 to 0.99 G, and the method is carried out at a temperature of between 5° and 120° C. Preferably, the solid particulate material comprises a multiplicity of particles at a particle to fabric addition level of 0.1:1-10:1 by mass, wherein the particles comprise polymeric particles, non-polymeric particles, or mixtures of polymeric and non-polymeric particles. All particles may be solid or hollow in their structure, have smooth or irregular surface features, and are of such a shape and size as to allow for good flowability and intimate contact with the wet substrate. The invention provides optimum drying performance as a result of improved mechanical interaction between substrate and particulate media and is preferably used for the drying of textile fabrics. The method allows for significant reduction in the consumption of energy when compared with the conventional tumble drying of textile fabrics, and also facilitates reduced textile fabric damage.

23 Claims, 3 Drawing Sheets

(51) Int. Cl.

| | |
|---|---|
| ***D06F 58/02*** | (2006.01) |
| ***F26B 3/20*** | (2006.01) |

(56) References Cited

U.S. PATENT DOCUMENTS

| | | | | | |
|---|---|---|---|---|---|
| 3,333,344 | A * | 8/1967 | Loewen | 34/520 | |
| 3,647,354 | A | 3/1972 | Loeb | | |
| 3,650,673 | A * | 3/1972 | Ehner | 8/137 | |
| 3,805,406 | A * | 4/1974 | Castonoli | 34/109 | |
| 4,055,248 | A | 10/1977 | Marsan | | |
| 4,130,392 | A | 12/1978 | Diehl et al. | | |
| 4,188,807 | A | 2/1980 | Graf et al. | | |
| 4,374,443 | A | 2/1983 | Mosell | | |
| 4,434,067 | A | 2/1984 | Malone et al. | | |
| 4,493,783 | A | 1/1985 | Su et al. | | |
| 4,575,887 | A | 3/1986 | Viramontes | | |
| 4,655,952 | A | 4/1987 | Mesmer et al. | | |
| 4,750,227 | A | 6/1988 | Hopkins et al. | | |
| 4,801,333 | A | 1/1989 | Mosell | | |
| 4,809,854 | A | 3/1989 | Tomaszek | | |
| 4,839,969 | A * | 6/1989 | Hahn | 34/169 | |
| 4,951,366 | A | 8/1990 | Geller | | |
| 4,978,619 | A | 12/1990 | Kajiwara et al. | | |
| 5,245,722 | A | 9/1993 | Dameron | | |
| 5,305,533 | A * | 4/1994 | Alexander et al. | 34/549 | |
| 5,468,175 | A | 11/1995 | Nilen | | |
| 5,475,992 | A | 12/1995 | Wiegert | | |
| 5,503,840 | A | 4/1996 | Jacobson et al. | | |
| 5,547,476 | A | 8/1996 | Siklosi et al. | | |
| 5,601,480 | A | 2/1997 | Nilen | | |
| 5,605,491 | A | 2/1997 | Yam et al. | | |
| 5,667,431 | A | 9/1997 | Mortin | | |
| 5,804,548 | A | 9/1998 | Davis | | |
| 5,925,195 | A | 7/1999 | King et al. | | |
| 5,980,620 | A | 11/1999 | Brodie et al. | | |
| 5,993,839 | A | 11/1999 | Mixon | | |
| 6,235,705 | B1 | 5/2001 | Zembrodt et al. | | |
| 6,348,441 | B1 | 2/2002 | Aiken, III et al. | | |
| 6,448,212 | B1 | 9/2002 | Holderbaum et al. | | |
| 7,070,489 | B2 | 7/2006 | Rogmark | | |
| 7,097,715 | B1 * | 8/2006 | Racette et al. | 134/26 | |
| 7,481,893 | B2 | 1/2009 | Motson et al. | | |
| 7,498,294 | B2 | 3/2009 | Konno et al. | | |
| 8,974,545 | B2 | 3/2015 | Burkinshaw et al. | | |
| 9,017,423 | B2 | 4/2015 | Burkinshaw et al. | | |
| 2002/0010300 | A1 | 1/2002 | Mimoun | | |
| 2002/0039976 | A1 | 4/2002 | Sebillotte-Arnaud et al. | | |
| 2002/0058595 | A1 | 5/2002 | Kaiser | | |
| 2003/0110580 | A1 * | 6/2003 | Burkinshaw et al. | 8/506 | |
| 2003/0134759 | A1 | 7/2003 | Geary et al. | | |
| 2004/0171515 | A1 | 9/2004 | Hamers et al. | | |
| 2004/0266641 | A1 | 12/2004 | Gentschev et al. | | |
| 2005/0148479 | A1 | 7/2005 | Barthel et al. | | |
| 2005/0153865 | A1 | 7/2005 | Detering et al. | | |
| 2005/0183206 | A1 | 8/2005 | Brown et al. | | |
| 2005/0183208 | A1 | 8/2005 | Scheper et al. | | |
| 2005/0204477 | A1 | 9/2005 | Casella et al. | | |
| 2006/0287212 | A1 | 12/2006 | Sommer et al. | | |
| 2007/0151312 | A1 * | 7/2007 | Bruce et al. | 68/3 R | |
| 2007/0270327 | A1 | 11/2007 | Beck et al. | | |
| 2008/0090746 | A1 | 4/2008 | Penninger | | |
| 2008/0223406 | A1 | 9/2008 | Lindqvist et al. | | |
| 2008/0306183 | A1 | 12/2008 | Leukel et al. | | |
| 2009/0090138 | A1 | 4/2009 | Wang | | |
| 2009/0186795 | A1 | 7/2009 | Feenstra et al. | | |
| 2009/0217461 | A1 | 9/2009 | Burkinshaw et al. | | |
| 2010/0281928 | A1 | 11/2010 | Martin | | |
| 2011/0296628 | A1 | 12/2011 | Jenkins et al. | | |
| 2012/0048299 | A1 | 3/2012 | Jenkins et al. | | |
| 2012/0111359 | A1 | 5/2012 | Mueller et al. | | |
| 2012/0284931 | A1 | 11/2012 | Jenkins et al. | | |
| 2012/0304400 | A1 * | 12/2012 | Jenkins et al. | 8/137 | |
| 2013/0061404 | A1 | 3/2013 | Jenkins | | |
| 2013/0167882 | A1 * | 7/2013 | Burkinshaw et al. | 134/34 | |
| 2013/0276242 | A1 * | 10/2013 | Jenkins et al. | 8/137 | |
| 2013/0281345 | A1 | 10/2013 | Burkinshaw et al. | | |
| 2013/0283542 | A1 | 10/2013 | Jenkins et al. | | |
| 2013/0305560 | A1 * | 11/2013 | Jenkins et al. | 34/499 | |
| 2014/0137340 | A1 | 5/2014 | Burkinshaw et al. | | |
| 2015/0096128 | A1 | 4/2015 | Sawford et al. | | |
| 2015/0096129 | A1 | 4/2015 | Sawford et al. | | |
| 2015/0128358 | A1 | 5/2015 | Wells et al. | | |
| 2015/0148278 | A1 | 5/2015 | Burkinshaw et al. | | |
| 2015/0152357 | A1 | 6/2015 | Abercrombie et al. | | |
| 2015/0152585 | A1 | 6/2015 | Sawford et al. | | |
| 2015/0175945 | A1 | 6/2015 | Waddon et al. | | |

FOREIGN PATENT DOCUMENTS

| | | | | | |
|---|---|---|---|---|---|
| CN | 2789299 | Y | 6/2006 | | |
| CN | 101886321 | A | 11/2010 | | |
| CN | 202500017 | U | 10/2012 | | |
| DE | 1900002 | A1 | 7/1970 | | |
| DE | 2819233 | A1 | 11/1979 | | |
| DE | 19505921 | A1 | 8/1996 | | |
| DE | 10247289 | A1 | 4/2004 | | |
| DE | 102008009462 | A1 | 8/2009 | | |
| DE | 102009046170 | A1 | 5/2011 | | |
| EP | 0090372 | A1 | 10/1983 | | |
| EP | 0171215 | A1 | 2/1986 | | |
| EP | 0807463 | A2 | 11/1997 | | |
| EP | 1371718 | A1 | 12/2003 | | |
| FR | 2525645 | A1 | 10/1983 | | |
| FR | 2826548 | A1 | 1/2003 | | |
| GB | 1018318.4 | | 1/1966 | | |
| GB | 920791 | A | 3/1968 | | |
| GB | 1256064 | A | 12/1971 | | |
| GB | 1297316 | A | 11/1972 | | |
| GB | 1379742 | A | 1/1975 | | |
| GB | 2249104 | A | 4/1992 | | |
| GB | 2302553 | A | 1/1997 | | |
| GB | 2365648 | A * | 2/2002 | H04N 9/64 | |
| GB | 2456407 | A | 7/2009 | | |
| JP | S59-48078 | A | 3/1984 | | |
| JP | H01285188 | A | 11/1989 | | |
| JP | H0257295 | A | 2/1990 | | |
| JP | H03-146094 | B2 | 6/1991 | | |
| JP | H04105633 | A | 7/1992 | | |
| JP | H04241165 | A | 8/1992 | | |
| JP | H06240297 | A | 8/1994 | | |
| JP | 2004238602 | A | 8/2004 | | |
| WO | WO 9837270 | A1 * | 8/1998 | D06P 1/52 | |
| WO | WO 9940251 | A1 * | 8/1999 | D06P 3/66 | |
| WO | WO-00/37540 | A1 | 6/2000 | | |
| WO | WO-00/77153 | A1 | 12/2000 | | |
| WO | WO-02/42403 | A1 | 5/2002 | | |
| WO | WO-03/054128 | A1 | 7/2003 | | |
| WO | WO-2004/066970 | A1 | 8/2004 | | |
| WO | WO-2006/020789 | A1 | 2/2006 | | |
| WO | WO 2006040539 | A1 * | 4/2006 | | |
| WO | WO-2007/070520 | A1 | 6/2007 | | |
| WO | WO-2007/128962 | A1 | 11/2007 | | |
| WO | WO-2008/132456 | A1 | 11/2008 | | |
| WO | WO-2009/021919 | A2 | 2/2009 | | |
| WO | WO-2009/112296 | A1 | 9/2009 | | |
| WO | WO-2009/134018 | A2 | 11/2009 | | |
| WO | WO-2010/046473 | A1 | 4/2010 | | |
| WO | WO-2010/094959 | A1 | 8/2010 | | |
| WO | WO-2010/128337 | A2 | 11/2010 | | |
| WO | WO-2010/133837 | A1 | 11/2010 | | |
| WO | WO-2010/139689 | A1 | 12/2010 | | |
| WO | WO-2011/015429 | A2 | 2/2011 | | |
| WO | WO-2011/051140 | A1 | 5/2011 | | |
| WO | WO-2011/064581 | A1 | 6/2011 | | |
| WO | WO-2011/098815 | A1 | 8/2011 | | |
| WO | WO-2011/128676 | A1 | 10/2011 | | |
| WO | WO-2011/128680 | A2 | 10/2011 | | |
| WO | WO-2012/035342 | A1 | 3/2012 | | |
| WO | WO-2012/035343 | A1 | 3/2012 | | |
| WO | WO-2012/056252 | A2 | 5/2012 | | |
| WO | WO-2012/084619 | A1 | 6/2012 | | |
| WO | WO-2012/098408 | A2 | 7/2012 | | |
| WO | WO-2012/104861 | A1 | 8/2012 | | |

(56) References Cited

FOREIGN PATENT DOCUMENTS

| | | | |
|---|---|---|---|
| WO | WO-2014/006424 | A1 | 1/2014 |
| WO | WO-2014/006425 | A1 | 1/2014 |
| WO | WO-2014/037729 | A1 | 3/2014 |

OTHER PUBLICATIONS

U.S. Appl. No. 14/588,500, Xeros Ltd.
U.S. Appl. No. 14/588,510, Xeros Ltd.
"Aqua Ball Set", <http://www.auravita.com/products/AURA/TAPR10610.asp>, retrieved on Aug. 14, 2006 (3 pages).
"Capture Carpet Cleaning Kit", <http://www.basichomeshopping.com/CaptureCarpetCleanerKit.html>, retrieved on Aug. 11, 2005 (4 pages).
"Capture Carpet Cleaning Kit", <http://www.domesticsale.com/Classifieds/15175.html>, retrieved on Aug. 11, 2005 (1 page).
Michalon et al., "Enzyme coupling method on calibrated nylon spheres: application to the selective trypsinization of histones in chromatin," Biochem Biophys Res Commun. 167(1):9-15 (1990).
Migneault et al., "Glutaraldehyde: behavior in aqueous solution, reaction with proteins, and application to enzyme crosslinking," Biotechniques. 37(5):790-802 (2004).
Silva et al., "Laccase immobilization on enzymatically functionalized polyamide 6,6 fibres," Enzyme Microb Technol. 41:867-75 (2007).
Talbert et al., "Chitosan-tethered microspheres for lactase immobilization," J Mol Catal B Enzym. 78:78-84 (2012).
International Search Report and Written Opinion for PCT/GB2012/050121, mailed Jun. 6, 2013 (11 pages).

* cited by examiner

Cylindrical , Spherical and Perfect Sphere Particle Size Parameters

Figure 2 % Moisture Retained After Drying vs. Time
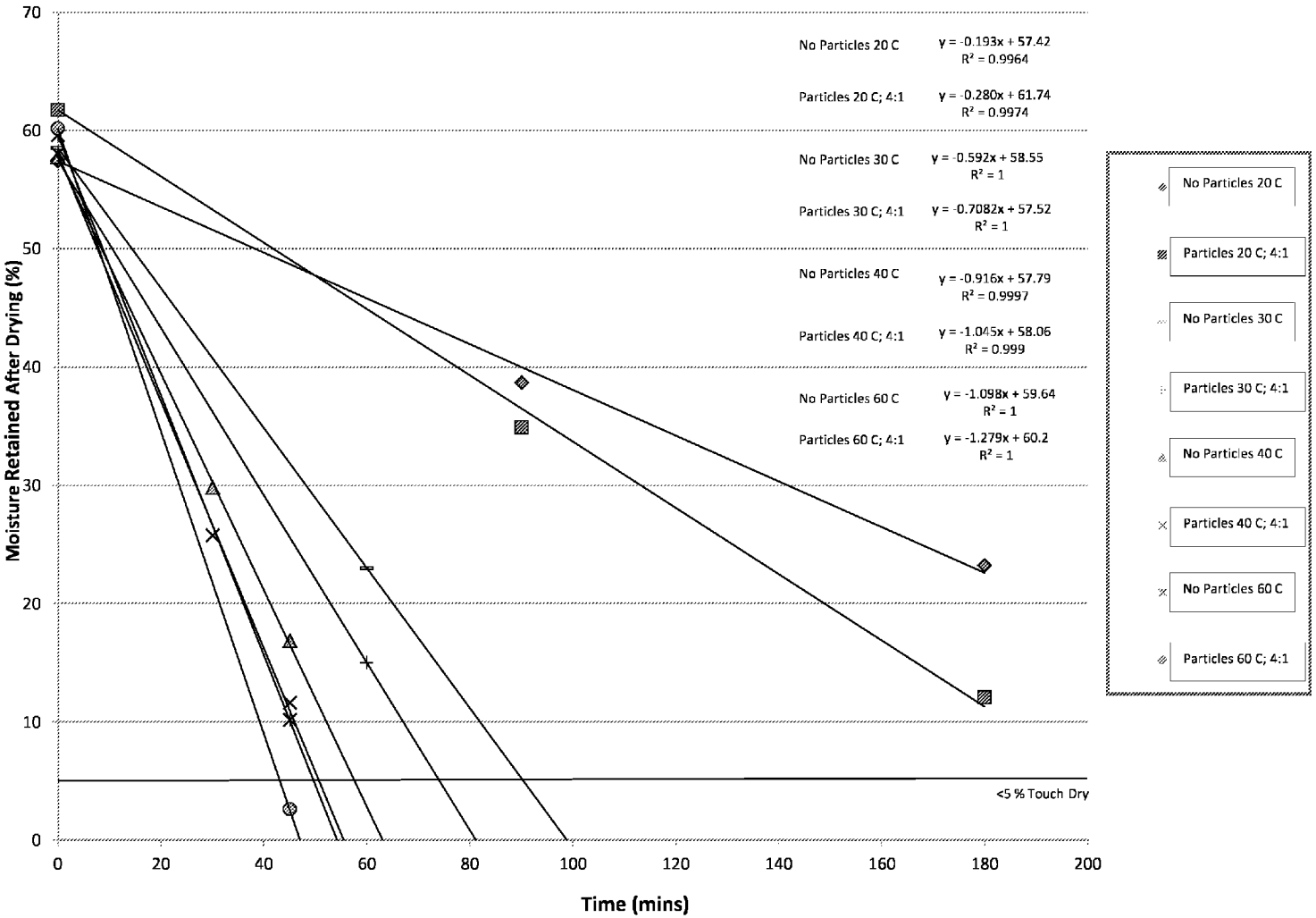

Figure 3 % Moisture Retained After Drying vs. Time
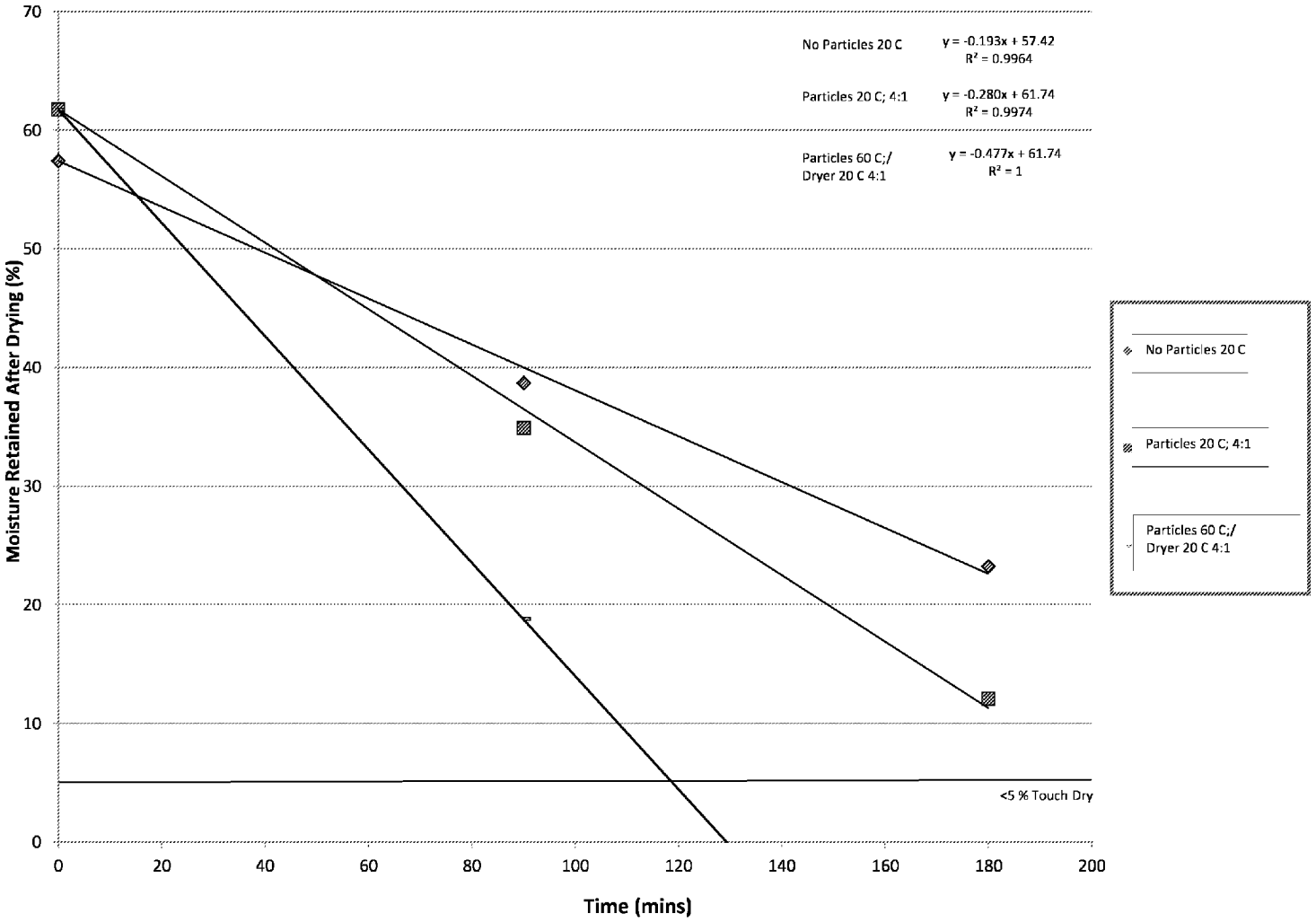

DRYING METHOD

CROSS-REFERENCE TO RELATED APPLICATIONS

This application is filed under the provisions of 35 U.S.C. §371 and claims the priority of International Patent Application No. PCT/GB2012/050121 filed on Jan. 19, 2012 which in turn claims priority of Great Britain Application No. 1100918.0 filed on Jan. 19, 2011, the contents of which are incorporated by reference herein for all purposes.

FIELD OF THE INVENTION

The present invention relates to the drying of textile fibres and fabrics in a tumble dryer using a system which utilises only limited quantities of energy, and which reduces drying-related creasing and associated textile fabric damage. Specifically, the invention provides a method adapted for use in this context.

BACKGROUND TO THE INVENTION

Tumble drying processes are a mainstay of both domestic and industrial textile fabric cleaning procedures and typically involve placing the textiles in a container such as a perforated cylindrical drum which is rotated in alternating clockwise and anti-clockwise cycles whilst hot air is introduced into the drum through the perforations. A combination of the hot air treatment and the mechanical action of the tumbling process causes water to be expelled from the textile materials in order that drying is achieved.

However, such processes, though generally very effective, are usually characterised by high levels of energy consumption, both in terms of effecting rotation of the container and, most particularly, in generating heated air. Typically, prior art processes may involve prolonged treatments at high temperatures in order to effect the required degree of drying. Clearly, however, the lower are the energy requirements of a system, the more efficient is the system and its associated drying process. Consequently, there is a desire to reduce both the time of such drying treatments and the temperature at which they are carried out in order to provide more efficient processes, whilst maintaining equivalent drying performance.

Current efficient domestic tumble dryers are graded in terms of energy consumption according to EU Directive 92/75/EEC and, more specifically, Directive 95/13/EEC, with category 'A' dryers being the most efficient, and category 'G' the least efficient. Hereinafter, energy consumptions are quoted for the cotton drying cycle for each machine type, in kWh/kg of drying load. Thus, for vented tumble dryers, 'A' class consumption is <0.51 kWh/kg, 'C' class (most common) is between 0.59 and 0.67 kWh/kg, whilst 'G' class is >0.91 kWh/kg. These values differ slightly for condenser tumble dryers, with 'A' class at <0.55 kWh/kg, 'C' class (most common) at between 0.64 and 0.73 kWh/kg, and 'G' class at >1.00 kWh/kg. With average domestic dryer capacities now at around 8.0 kg, this equates to a typical consumption for a 'C' class vented tumble dryer of 4.7-5.4 kWh/cycle; an 'A' class equivalent machine would run at <4.1 kWh/cycle. Some vented domestic dryers are now capable of performing beyond this lower limit and, at the time of writing, the energy labelling system in the European Union is being adjusted in line with this, such that tumble dryers will soon move to A+ and A++ labels. Performance levels in the domestic sector generally set the highest standard for an efficient fabric drying process. Energy consumption in industrial tumble drying is usually higher, due to the need for faster cycle times. It is also noteworthy that, overall, tumble drying is significantly less efficient than washing as a component part of the laundry process in either sector.

Heating of the circulating air is the principal use of energy in such tumble dryers and the present inventors have therefore sought to effect improvements in the prior art processes by reducing the temperature levels required in such processes. This has been possible by means of changes made to the mechanical action of the process on the fabric in the drying load. Mechanical action in a conventional, horizontal axis tumble dryer is generated by the forces acting on the fabric through falling and hitting either other fabric or the dryer inner drum surface, whilst the fabric is interacting with the forced hot air flow. This results in release and evaporation of water from within the fabric, and hence drying. In the method herein provided, alteration of the mechanical action of the process in order to promote more localised release and evaporation of water at the fabric surface has resulted in lower drying temperatures. As a further potential benefit, it has been found that the changes made can also reduce the degree of fabric folding, and hence the level of creasing associated with tumble drying. Creasing, which concentrates stresses during this drying process, is a major source of localised fabric damage. Ironing at high temperatures is then the conventional means used to remove such creasing and this, too, brings a fabric damage penalty. Prevention of fabric damage (i.e. fabric care) is of primary concern to the domestic consumer and the industrial user. Furthermore, if creasing is reduced, there is also the secondary benefit to the user of convenience resulting from less ironing.

Hence, the present inventors have sought to devise a new approach to the drying problem, which allows the above deficiencies associated with the methods of the prior art to be overcome. The method which is provided eliminates the requirement for the use of high drying temperatures for extended periods of time, but is still capable of providing an efficient means of water removal, so yielding economic and environmental benefits. The method which is provided also promotes fabric care through reduced creasing and fewer requirements for subsequent ironing.

In WO-A-2007/128962 there is disclosed a method and formulation for cleaning a soiled substrate, the method comprising the treatment of the moistened substrate with a formulation comprising a multiplicity of polymeric particles, wherein the formulation is free of organic solvents. In preferred embodiments, the substrate comprises a textile fibre and the polymeric particles may, for example, comprise particles of polyamides, polyesters, polyalkenes, polyurethanes or their copolymers, but are most preferably in the form of nylon particles.

The method disclosed in this prior art document has been highly successful in providing an efficient means of cleaning and stain removal which also yields significant economic and environmental benefits due to its use of a cleaning formulation which requires the use of only limited amounts of water. The present inventors have now sought to provide a drying process which adopts a similar approach to that disclosed in WO-A-2007/128962, and which offers benefits in terms of reduced energy requirements, whilst still providing an acceptable level of performance, and have succeeded in achieving at least equivalent drying performance whilst employing significantly reduced process temperatures. Thus, a process is provided wherein the drying effect achieved as a consequence of mechanical interaction of a wet substrate with physical media is optimised, such that excellent drying performance may be achieved at much lower temperatures (i.e. low energy) without extending drying times. Additional benefits have also been observed in terms of the reduction of fabric creasing and associated fabric damage.

SUMMARY OF THE INVENTION

The present invention derives from an appreciation on the part of the inventors that optimum drying performance can be achieved as a result of improved mechanical interaction between substrate and physical media. This can be effected by the use of solid particles in the drying process and is a function of the number, size and mass of the particles and the free volume within the vessel in which the drying operation takes place, in addition to the G force dictated by its speed of rotation. Free volume in this context refers to the space inside the vessel which remains unoccupied by wet substrate or particulate media, and G force is defined on the basis of the centripetal forces which are acting.

Thus, according to a first aspect of the present invention, there is provided a method for the drying of a wet substrate, said method comprising treating the substrate with a solid particulate material at ambient or elevated temperature, said treatment being carried out in an apparatus comprising a drum comprising perforated side walls, wherein said drum comprising perforated side walls is rotated so as to facilitate increased mechanical action between said substrate and said particulate material.

In an embodiment of the invention, said drum comprising perforated side walls has a capacity of between 5 and 50 liters for each kg of substrate. Typically, said drum is rotated at a speed which generates G forces in the range of from 0.05 to 0.99 G.

In certain embodiments of the invention, the drum comprising perforated side walls comprises a rotatably mounted cylindrical cage.

Typically, said solid particulate material comprises a multiplicity of particles which may be polymeric, non-polymeric or mixtures thereof, and which may be added at a particle to fabric addition level of 0.1:1-10:1 by mass.

The size of said particles, in combination with their material density and the total particle to fabric addition level, determines the number of particles which are present in a process according to the invention. Each particle may have a smooth or irregular surface structure, can be of solid or hollow construction, and is of such a shape and size to allow for good flowability and intimate contact with the soiled substrate, which typically comprises a textile fabric. A variety of shapes of particles can be used, such as cylindrical, spherical or cuboid; appropriate cross-sectional shapes can be employed including, for example, annular ring, dog-bone and circular. Most preferably, however, said particles comprise cylindrical or spherical particles.

Polymeric particles typically have an average density in the range of 0.5-2.5 g/cm$^3$, more typically from 0.55-2.0 g/cm$^3$, more typically from 0.6-1.9 g/cm$^3$. Non-polymeric particles generally have an average density in the range of from 3.5-12.0 g/cm$^3$, more typically from 5.0-10.0 g/cm$^3$, most typically from 6.0-9.0 g/cm$^3$. The average volume of both the non-polymeric and polymeric particles is typically in the range of 5-275 mm$^3$, more typically from 8-140 mm$^3$, most typically from 10-120 mm$^3$.

In the case of cylindrical particles—both polymeric and non-polymeric—of oval cross section, the major cross section axis length, a, is typically in the range of from 2.0-6.0 mm, more typically from 2.2-5.0 mm, most typically from 2.4-4.5 mm, and the minor cross section axis length, b, is typically in the range of from 1.3-5.0 mm, more typically from 1.5-4.0 mm, and most typically from 1.7-3.5 mm (a>b). The length of such particles, h, is typically from 1.5-6.0 mm, more typically from 1.7-5.0 mm, and most typically from 2.0-4.5 mm (h/b is typically in the range of from 0.5-10).

For cylindrical particles—both polymeric and non-polymeric—of circular cross section, the typical cross section diameter, $d_c$, is in the range of from 1.3-6.0 mm, more typically from 1.5-5.0 mm, and most typically from 1.7-4.5 mm. The typical length, hp, of such particles is again from 1.5-6.0 mm, more typically from 1.7-5.0 mm, and most typically from 2.0-4.5 mm ($h_c/d_c$ is typically in the range of from 0.5-10).

In the case of both polymeric and non-polymeric spherical particles (not perfect spheres) the diameter, $d_s$, is typically in the range of from 2.0-8.0 mm, more typically in the range of from 2.2-5.5 mm, and most typically from 2.4-5.0 mm.

In embodiments where the particles, whether polymeric or non-polymeric, are perfect spheres, the diameter, $d_{ps}$, is typically in the range of from 2.0-8.0 mm, more typically from 3.0-7.0 mm, and most typically from 4.0-6.5 mm.

Polymeric particles may comprise either foamed or unfoamed polymeric materials. Furthermore, the polymeric particles may comprise polymers which are either linear or crosslinked.

Preferred polymeric particles comprise polyalkenes such as polyethylene and polypropylene, polyamides, polyesters or polyurethanes. Preferably, however, said polymeric particles comprise polyamide or polyester particles, most particularly particles of nylon, polyethylene terephthalate or polybutylene terephthalate.

Optionally, copolymers of the above polymeric materials may be employed for the purposes of the invention. Specifically, the properties of the polymeric materials may be tailored to individual requirements by the inclusion of monomeric units which confer particular properties on the copolymer. Thus, the copolymers may be adapted to attract moisture by comprising monomers which, inter alia, are hydrophilic through being ionically charged or including polar moieties or unsaturated organic groups.

Non-polymeric particles may comprise particles of glass, silica, stone, wood, or any of a variety of metals or ceramic materials. Suitable metals include, but are not limited to, zinc, titanium, chromium, manganese, iron, cobalt, nickel, copper, tungsten, aluminium, tin and lead, and alloys thereof. Suitable ceramics include, but are not limited to, alumina, zirconia, tungsten carbide, silicon carbide and silicon nitride. It is seen that non-polymeric particles made from naturally occurring materials (e.g. stone) can have various shapes, depending on their propensity to cleave in different ways during manufacture.

In further embodiments of the invention, said non-polymeric particles may comprise coated non-polymeric particles. Most particularly, said non-polymeric particles may comprise a non-polymeric core material and a shell comprising a coating of a polymeric material. In a particular embodiment, said core may comprise a metal core, typically a steel core, and said shell may comprise a polyamide coating, for example a coating of nylon.

In accordance with the present invention, the selection of specific particle type (polymeric and non-polymeric) for a given drying operation is particularly important in optimising fabric care. Thus, particle size, shape, mass and material must all be considered carefully in respect of the particular substrate which is to be dried, so that particle selection is dependent on the nature of the garments to be dried, i.e. whether they comprise cotton, polyester, polyamide, silk, wool, or any of the other common textile fibres or blends which are commonly in use.

The generation of suitable G forces, in combination with the action of the solid particulate material, is a key factor in achieving an appropriate level of mechanical action on the wet substrate. G is a function of the drum size and the speed of rotation of the drum and, specifically, is the ratio of the centripetal force generated at the inner surface of the cage to the static weight of the wet substrate. Thus, for a cage of inner radius r (m), rotating at R (rpm), with a load of mass M (kg), and an instantaneous tangential velocity of the cage v (m/s), and taking g as the acceleration due to gravity at 9.81 $m/s^2$:

Centripetal force$=Mv^2/r$

Load static weight$=Mg$ $v=2\pi rR/60$

Hence, $G=4\pi^2r^2R^2/3600$ $rg=4\pi^2rR^2/3600$ $g=1.18\times10^{-3}rR^2$

When, as is usually the case, r is expressed in centimeters, rather than meters, then:

$G=1.118\times10^{-5}rR^2$

Hence, in a preferred embodiment of the invention, for a drum of radius 37 cm (diameter 74 cm) rotating at 48 rpm, G=0.95. Typically, for such a drum, optimum speeds of rotation are in the range of from 10 to 49 rpm.

In preferred embodiments of the invention, the claimed method additionally provides, on completion of the drying process, for separation and recovery of the particles comprised in the solid particulate material, which are then re-used in subsequent drying procedures.

Said rotatably mounted cylindrical cage is comprised in any suitable tumble drying apparatus comprising a housing and access means, allowing access to the interior of said cylindrical cage. In a preferred embodiment, said apparatus may comprise:

(a) housing means, having:
  (i) a first upper chamber having mounted therein said rotatably mounted cylindrical cage, and
  (ii) a second lower chamber located beneath said cylindrical cage;
(b) recirculation means;
(c) access means;
(d) pumping means; and
(e) delivery means, wherein said rotatably mounted cylindrical cage comprises a drum comprising perforated side walls, wherein up to 60% of the surface area of said side walls comprises perforations, and said perforations comprise holes having a diameter of no greater than 25.0 mm.

Said drying process also comprises the introduction of either ambient or heated air into said drum comprising perforated side walls. If said air is heated, this is achieved by means of any commercially available air heater and circulated using a fan so as to achieve a temperature of between 5° and 120° C., preferably between 10° and 90° C., most preferably between 20° and 80° C. in the apparatus. The temperature of ambient air is dependent on the surroundings in which the drying process is running, but this can typically vary from 5-20° C.

It should be particularly noted that heating the air naturally results in heating of the particulate media in the drying process. This heat then is retained by the particles on completion of a drying cycle and, hence, if the next drying cycle occurs within the time taken for the particles to cool down, there will be a transfer of this retained heat to that subsequent drying process. There is, therefore, an even greater level of drying efficiency achievable in the event that multiple drying cycles are run consecutively. This is, of course, applicable to both the domestic and industrial laundry sectors—but, most particularly, to the latter. Rapid turnaround of drying cycles and high load throughput are both key factors in this kind of drying operation in an industrial scenario.

As a consequence of employing the method of the present invention, excellent drying performance may be achieved whilst using reduced temperatures (i.e. lower energy consumption), without increasing drying times. Thus, drying operations according to the invention are typically carried out at temperatures which are 20° C. lower than with prior art processes, whilst achieving equivalent drying performance for the same time of treatment.

BRIEF DESCRIPTION OF THE DRAWINGS

Embodiments of the invention are further described hereinafter with reference to the accompanying drawings, in which:

FIG. 2 is a graphical representation of the efficiency of the drying process according to an embodiment of the invention; and FIG. 3 a graphical representation of the efficiency of the drying process according to a further embodiment of the invention.

DETAILED DESCRIPTION OF THE INVENTION

Figure 1:
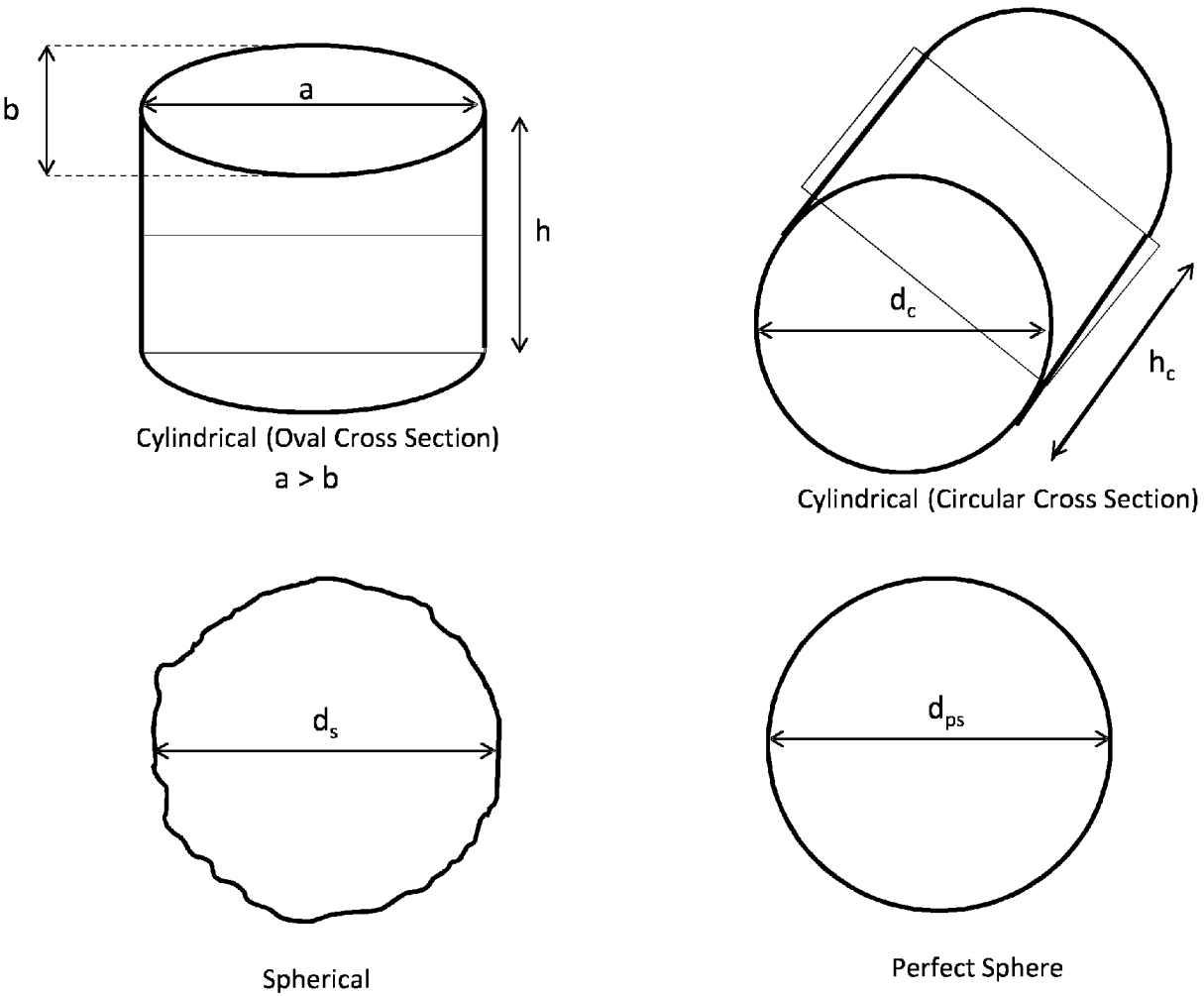
FIG. 1 is a diagrammatic representation of particles which are employed in the method of the invention.

In apparatus employed in the method of the invention, said access means typically comprises a hinged door mounted in the casing, which may be opened to allow access to the inside of the cylindrical cage, and which may be closed in order to provide a substantially sealed system. Preferably, the door includes a window.

Said rotatably mounted cylindrical cage is mounted horizontally within said housing means. Consequently, in preferred embodiments of the invention, said access means is located in the front of the apparatus, providing a front-loading facility.

Rotation of said rotatably mounted cylindrical cage is effected by use of drive means, which typically comprises electrical drive means, in the form of an electric motor. Operation of said drive means is effected by control means which may be programmed by an operative.

Said rotatably mounted cylindrical cage is of the size which is to be found in most domestic or industrial tumble driers, and may have a capacity in the region of 50 to 7000 liters. A typical capacity for a domestic machine would be in the region of 80 to 140 liters and, for an industrial machine, this range would typically be from 170 to 2000 liters.

Said rotatably mounted cylindrical cage is located within a first upper chamber of said housing means and beneath said first upper chamber is located a second lower chamber which functions as a collection chamber for said solid particulate material.

Said housing means is connected to standard plumbing features, thereby providing recirculation means, for returning said solid particulate material from said lower chamber, and delivery means, by virtue of which said solid particulate material may be returned to said cylindrical cage.

In operation according to the method of the invention, agitation is provided by rotation of said rotatably mounted cylindrical cage and by the introduction of heated air. Thus, said apparatus additionally comprises means for circulating air within said housing means, and for adjusting the temperature therein. Said means may typically include, for example, a recirculating fan and an air heater. Additionally, sensing means may also be provided for determining the temperature and humidity levels within the apparatus, and for communicating this information to the control means.

Said apparatus comprises recirculation means, thereby facilitating recirculation of said solid particulate material from said lower chamber to said rotatably mounted cylindrical cage, for re-use in drying operations. Preferably, said recirculation means comprises ducting connecting said second chamber and said rotatably mounted cylindrical cage. More preferably, said ducting comprises control means, adapted to control entry of said solid particulate material into said cylindrical cage. Typically, said control means comprises a valve located in feeder means, preferably in the form of a feed tube attached to the apex of a receptor vessel located above, and connected to the interior of, said cylindrical cage.

Recirculation of solid particulate matter from said lower chamber to said rotatably mounted cylindrical cage is achieved by the use of pumping means comprised in said recirculation means, wherein said pumping means are adapted to deliver said solid particulate matter to said control means, adapted to control the re-entry of said solid particulate matter into said rotatably mounted cylindrical cage. Preferably, said recirculation means comprises a vacuum pumping system.

In operation according to the method of the invention, during a typical cycle, cleaned garments containing residual moisture are first placed into said rotatably mounted cylindrical cage. The cylindrical cage is caused to rotate and ambient or heated air is introduced via the perforations in the cage before the solid particulate material is added. During the course of agitation by rotation of the cage, water is caused to be removed from the garments by evaporation and a quantity of the solid particulate material falls through the perforations in the cage and into the second chamber of the apparatus. Thereafter, the solid particulate material is re-circulated via the recirculation means such that it is returned, in a manner controlled by said control means, to the cylindrical cage for continuation of the drying operation. This process of continuous circulation of the solid particulate material occurs throughout the drying operation until drying is completed.

Thus, the solid particulate material which exits through the perforations in the walls of said rotatably mounted cylindrical cage and into said second chamber is carried to the top side of said rotatably mounted cylindrical cage, wherein it is caused, by means of gravity and operation of the control means, to fall back into said cage, thereby to continue the drying operation.

Preferably, pumping of fresh and recycled solid particulate material proceeds at a rate sufficient to maintain approximately the same level of material in said rotatably mounted cylindrical cage throughout the drying operation, and to ensure that the ratio of particulate material to substrate stays substantially constant until the cycle has been completed.

On completion of the cycle, feeding of solid particulate material into the rotatably mounted cylindrical cage ceases but rotation of the cage continues so as to allow for removal of the solid particulate material. Air heating and re-circulation may also be stopped at this point. After separation, the solid particulate material is preferably recovered in order to allow for re-use in subsequent drying operations. Said separation of particulate material removes >99% of these particles, and typically removal rates approach, or actually reach, 100%.

Generally, any remaining solid particulate material on said at least one substrate may be easily removed by shaking the at least one substrate. If necessary, however, further remaining solid particulate material may be removed by suction means, preferably comprising a vacuum wand.

Said rotatably mounted cylindrical cage more preferably has a volume of between 5 and 50 liters for each kg of fabric in the load. Preferred rates of rotation of said rotatably mounted cylindrical cage are sufficient to give G forces of between 0.05 and 0.99 G. Typically the drying process and the subsequent separation of the particles from the fabric are both carried out within this G range. After separation, the particles are recovered for use in subsequent drying procedures.

According to the method of the invention, said apparatus operates in conjunction with wet substrates and drying media comprising a solid particulate material, which is most preferably in the form of a multiplicity of particles which may be polymeric, non-polymeric, or mixtures of both polymeric and non-polymeric particles. All particles may be solid or hollow in their structure and the polymeric particles may be foamed or unfoamed and linear or crosslinked. These particles are required to be efficiently circulated to promote optimum performance and the apparatus, therefore, preferably includes circulation means. Thus, the inner surface of the cylindrical side walls of said rotatably mounted cylindrical cage preferably comprises a multiplicity of spaced apart elongated protrusions affixed essentially perpendicularly to said inner surface. Preferably, said protrusions additionally comprise air amplifiers which are typically driven pneumatically and are adapted so as to promote circulation of a current of heated air within said cage. Typically said apparatus comprises from 3 to 10, most preferably 4, of said protrusions, which are commonly referred to as lifters.

The method of the invention may be applied to the drying of any of a wide range of substrates including, for example, plastics materials, leather, metal or wood. In practice, however, said method is principally applied to the drying of wet substrates comprising textile fibres and fabrics, and has been shown to be particularly successful in achieving efficient drying of textile fabrics which may, for example, comprise either natural fibres, such as cotton, or man-made and synthetic textile fibres, for example nylon 6,6, polyester, cellulose acetate, or fibre blends thereof.

Most preferably, the solid particulate material comprises a multiplicity of particles which may be polymeric, non-polymeric, or mixtures thereof. Typical polymeric particles may comprise polyamide or polyester particles, most particularly particles of nylon, polyethylene terephthalate or polybutylene terephthalate, or copolymers thereof, most preferably in the form of beads, which may be solid or hollow in their structure. The polymers may be foamed or unfoamed, and may be linear or crosslinked. Various nylon or polyester homo- or co-polymers may be used including, but not limited to, Nylon 6, Nylon 6,6, polyethylene terephthalate and polybutylene terephthalate. Preferably, the nylon comprises Nylon 6,6 homopolymer having a molecular weight in the region of from 5000 to 30000 Daltons, preferably from 10000 to 20000 Daltons, most preferably from 15000 to 16000 Daltons. The polyester will typically have a molecular weight corresponding to an intrinsic viscosity measurement in the range of from 0.3-1.5 dl/g as measured by a solution technique such as ASTM D-4603.

Suitable non-polymeric particles may comprise particles of glass, silica, stone, wood, or any of a variety of metals or ceramic materials. Suitable metals include, but are not limited to, zinc, titanium, chromium, manganese, iron, cobalt, nickel, copper, tungsten, aluminium, tin and lead, and alloys thereof. Suitable ceramics include, but are not limited to, alumina, zirconia, tungsten carbide, silicon carbide and silicon nitride. It is seen that non-polymeric particles made from naturally occurring materials (e.g. stone) can have various shapes, depending on their propensity to cleave in different ways during manufacture.

Said solid particulate cleaning material may be comprised entirely of polymeric particles or entirely of non-polymeric particles, or may comprise mixtures of both types of particles. In embodiments of the invention wherein said solid particulate cleaning material comprises both polymeric particles and non-polymeric particles, the ratio of polymeric particles to non-polymeric particles may be anywhere from 99.9%:0.1% to 0.1%:99.9% w/w. Certain embodiments envisage ratios of from 95.0%:5.0% to 5.0%:95.0% w/w, or from 80.0%:20.0% to 20.0%:80.0% w/w, of polymeric particles to non-polymeric particles.

The ratio of solid particulate material to substrate is generally in the range of from 0.1:1 to 10:1 w/w, preferably in the region of from 1.0:1 to 7:1 w/w, with particularly favourable results being achieved using polymeric particles at a ratio of between 3:1 and 5:1 w/w, and especially at around 4:1 w/w. Thus, for example, for the drying of 5 g of fabric, 20 g of polymeric particles would be employed in one embodiment of the invention. The ratio of solid particulate material to substrate is maintained at a substantially constant level throughout the drying cycle.

The method of the present invention may be used for either small or large scale batchwise processes and finds application in both domestic and industrial drying processes.

As previously noted, the method of the invention finds particular application in the drying of textile fabrics. The conditions employed in such a system do, however, allow the use of significantly reduced temperatures from those which typically apply to the conventional tumble drying of textile fabrics and, as a consequence, offer significant environmental and economic benefits. Thus, typical procedures and conditions for the drying cycle require that fabrics are generally treated according to the method of the invention at, for example, temperatures of between 20 and 80° C. for a duration of between 5 and 55 minutes. Thereafter, additional time is required for the completion of the particle separation stage of the overall process, so that the total duration of the entire cycle is typically in the region of 1 hour.

The results obtained are very much in line with those observed when carrying out conventional tumble drying procedures with textile fabrics. The extent of water removal achieved with fabrics treated by the method of the invention is seen to be very good. The temperature requirement is significantly lower than the levels associated with the use of conventional tumble drying procedures, again offering significant advantages in terms of cost and environmental benefits.

The method of the invention also shows benefits in terms of reducing drying-related fabric damage. As previously observed, fabric creasing readily occurs in conventional tumble drying, and this acts to concentrate the stresses from the mechanical action of the drying process at each crease, resulting in localised fabric damage. Prevention of such fabric damage (or fabric care) is of primary concern to the domestic consumer and industrial user. The addition of particles according to the method of the invention effectively reduces creasing in the process by acting as a pinning layer on the fabric surface in order to help prevent the folding action. The particles also inhibit interaction between separate pieces of fabric in the drying process by acting as a separation or spacing layer, thereby reducing entanglement which is another major cause of localised fabric damage. In the presently disclosed method, mechanical action is still present but, critically, this is much more uniformly distributed as a result of the action of the particles. It is the localised aspect of the damage that determines the lifetime of a garment under multiple drying processes.

Thus, the method of the present invention provides for enhanced performance in comparison with the methods of the prior art under equivalent energy conditions; alternatively, equivalent drying performance may be achieved at lower levels of energy, together with reduced fabric damage.

During the drying cycle, the solid particulate material is continually falling out of the rotatably mounted cylindrical cage through its perforations, and is being recycled and added, together with fresh material, via the control means. This process may either be controlled manually, or operated automatically. The rate of exit of the solid particulate material from the rotatably mounted cylindrical cage is essentially controlled by means of its specific design. The key parameters in this regard include the size of the perforations, the number of perforations, the arrangement of the perforations within the cage and the G force (or rotational speed) which is employed.

Clearly, it is required that the perforations should be sized so as to be at least the size of the largest dimension of the particles comprised in the solid particulate material, in order that these particles are able to exit from the cage. For the preferred particle size range, however, optimum separation of particles from fabric is achieved when the perforations are sized at around 1-3 times the largest particle dimension which, typically, results in perforations having a diameter of between 2.0 and 25.0 mm. In one embodiment of the invention, a rotatably mounted cylindrical cage would be drilled so that only around 34% of the surface area of the cylindrical walls of the cage comprises perforations. Whilst restricting air flow, this allows for greater retention of solid particulate material in the drying load. The perforations may be banded in stripes or distributed evenly over the cylindrical walls of the rotatably mounted cylindrical cage, or could even be exclusively located, for example, in one half of the cage.

Conventional commercial vented tumble dryers (e.g. Danube™—Model Number TD2005/10E), typically have perforations of 6.5 mm diameter, and these are drilled at maximum areal density, such that they are distributed closely packed (1 mm apart) over the cylindrical cage wall. This equates to some 56% of the surface area of the cylindrical walls of the cage comprising perforations which ensures good air flow through the drying load, and this cage geometry is also found to be suitable for the successful performance of the method of the present invention.

The rate of exit of the solid particulate material from the rotatably mounted cylindrical cage is also affected by the speed of rotation of said cage, with higher rotation speeds increasing the G force, although at G>1 the fabric adheres to the sides of the cage and prevents exit of the particulate material. Hence, slower rotational speeds have been found to provide optimum results in this regard, as they allow the particles to fall from the fabric and through the perforations as the fabric opens out more during tumbling. Rotational speeds resulting in a G force of <1 are therefore required (<42 rpm in a 98 cm diameter cage, for example). The G force (or rotational speed) is also controlled so as to maximise the beneficial effect of the mechanical action of the particulate material on the substrate, and the most suitable G is generally found to be in the region of 0.9 G (e.g. 40 rpm in a 98 cm diameter cage).

On completion of the drying cycle, addition of solid particulate material to the rotatably mounted cylindrical cage is ceased, but the rotation G and rotational speed are maintained at the same values of <1 and low (40) rpm as in the drying cycle in order to effect the removal of particulate material;

this removal of particles generally takes around 5-20 minutes, with the drying cycle in a typical operation typically taking 40-55 minutes, giving a total overall cycle time in the region of 1 hour.

The method of the invention has been shown to be successful in the removal of particulate material from the dried substrate after processing and tests with cylindrical polyester particles, and nylon particles comprising either Nylon 6 or Nylon 6,6 polymer, have indicated particle removal efficacy such that on average <5 particles per garment remain in the load at the end of the particle separation cycle. Generally, this can be further reduced to an average of <2 particles per garment and, in optimised cases wherein a 20 minute separation cycle is employed, complete removal of particles is typically achieved.

Additionally, it has been demonstrated that re-utilisation of the particles in the manner described operates well, so that particles can be satisfactorily re-used in subsequent drying procedures. Indeed such re-utilisation offers further advantages in terms of energy efficiency, as heating the air naturally results in heating of the particulate media in the drying process. This heat then is retained by the particles on completion of a drying cycle and, hence, if the next drying cycle occurs within the time taken for the particles to cool down, there will be a transfer of this retained heat to that subsequent drying process. There is, therefore, an even greater level of drying efficiency achievable in the event that multiple drying cycles are run consecutively. This is, of course, applicable to both the domestic and industrial laundry sectors—but, most particularly, to the latter. Rapid turnaround of drying cycles and high load throughput are both key factors in this kind of drying operation in an industrial scenario.

The method of the invention is believed to comprise the mechanical action of the particles against a cloth so as to liberate the moisture trapped between fibres, and the pick up of this moisture on the particle surface, wherein rapid evaporation occurs of the thin film of water which is formed. Certain polymeric particles also have the ability to absorb moisture to a larger extent (Nylon 6 and Nylon 6,6 being examples). It may be the case, therefore, that some such absorption is also contributing to the drying mechanism.

The invention will now be further illustrated, though without in any way limiting the scope thereof, by reference to the following examples and associated illustrations.

EXAMPLES

Example 1

A drying procedure was carried out by adding a solid particulate material comprising 4 kg of Nylon 6,6 particles (DuPont Zytel® 101 NC010) to a mesh bag with 1 kg (dry mass) of a cloth substrate, which had been wetted with 10° C. water. Details of the particles are set out in Table 1 and an illustration of these cylindrical particles is provided in FIG. 1.

TABLE 1

PARTICULATE MATERIAL

| Particle Type | Particle Shape | a (mm) | b (mm) | h (mm) | Particle Volume ($mm^3$) | Particle Density ($g/cm^3$) | Particle Mass (mg) |
|---|---|---|---|---|---|---|---|
| DuPont Zytel ® 101 NC010 (Nylon 6,6) | Cylindrical (Oval Cross Section) | 2.5 | 1.8 | 3.1 | 10.5 | 1.1 | 12 |

The substrate was made up of the same type of article in each case (cotton pillowcases). This bag was then loaded into a conventional commercial vented tumble dryer (Danube™—Model Number TD 2005/10E). The dryer was set to rotate at 48 rpm which, with a drum diameter of 74 cm, resulted in a centripetal force on the bag and its contents of 0.95 G. The dryer operating temperature was set to 20°, 30°, 40°, or 60° C. for individual separate drying tests, and repeat experiments were performed without particles present (i.e. fabric only) to act as controls. The heat up rate programmed into the dryer was 2.0° C./min. and experiments were run for various times up to 3 hours, in order to be able to extrapolate accurately the overall drying efficiency, which is expressed as % water removed/minute of drying time. The substrate was uniformly wetted out to ~60% w/w moisture content at the start of each test (measured individually). The results are set out in Table 2 and are illustrated in FIG. 2.

TABLE 2

DRYING TEST RESULTS

| Test Type and Temperature | Drying Rate (% Water Removed/min) | Drying Rate Improvement versus Control (%) | Drying Time to 5% Moisture Retained (mins) | Drying Time to 5% Moisture Retained Improvement versus Control (%) |
|---|---|---|---|---|
| No Particles/20° C. (Control) | 0.19 | N/A | 289 | N/A |
| Particles/20° C. | 0.28 | 47 | 196 | 32 |

TABLE 2-continued

| DRYING TEST RESULTS | | | | |
|---|---|---|---|---|
| Test Type and Temperature | Drying Rate (% Water Removed/min) | Drying Rate Improvement versus Control (%) | Drying Time to 5% Moisture Retained (mins) | Drying Time to 5% Moisture Retained Improvement versus Control (%) |
| No Particles/30° C. (Control) | 0.59 | N/A | 93 | N/A |
| Particles/30° C. | 0.71 | 20 | 77 | 17 |
| No Particles/40° C. (Control) | 0.91 | N/A | 60 | N/A |
| Particles/40° C. | 1.05 | 15 | 52 | 13 |
| No Particles/60° C. (Control) | 1.10 | N/A | 50 | N/A |
| Particles/60° C. | 1.28 | 16 | 43 | 14 |

Here it can be seen that in all cases the addition of particles has reduced the drying time at the same drying temperature. Even at 20° C. (effectively ambient temperature with the heaters in the dryer switched off), there is a significant reduction in drying time (defined as the time to reach 5% moisture retention—touch dry). In terms of drying efficiency (% water removed/minute of drying time) at 20° C. this has increased with particles from 0.19 to 0.28% water/min (+47%); at 30° C. the increase is from 0.59 to 0.71% water/min (+20%), whilst at 40° C. the increase is from 0.91 to 1.05% water/min (+15%), and at 60° C. the increase is from 1.10 to 1.28% water/min (+16%). The most interesting comparison, however, is that the test denoted 'Particles/40° C.' has the same drying time as the test denoted 'Particles/60° C.'—or, put another way, the same drying time (−52 mins) is achieved with the use of particles, but at a 20° C. lower drying temperature. This is extremely beneficial considering the energy consumptions of such machines as previously described—even when the most efficient domestic models are considered. It appears therefore, that the extra thermal mass of the polymer particles (i.e. their mass×specific heat capacity) is not hindering improved drying performance, although this clearly becomes more of a consideration as the drying temperature increases, as can be seen the relative % improvements in drying efficiency which are shown.

Example 2

Table 3 and FIG. 3 provide a comparative illustration of the drying efficacy which is achieved when heated particles are employed. These data effectively provide an illustration of the benefits associated with heat retention in the particles for a subsequent drying process. Here, however, the particles were pre-heated in a separate tumble dryer to 60° C. (measured by an in-situ remote temperature recorder) in order to simulate heated particles from a previous cycle. These hot particles were then quickly added to the mesh bag with wet cloth as before, and tumbled in the Danube™ dryer at 20° C. (the test denoted 'Particles 60° C./Dryer 20° C.'). As previously therefore, this was effectively ambient temperature with the heaters in the dryer switched off. With heated particles, the drying efficiency increased to 0.48% water removed/minute, vs. the test from Example 1 with the particles at 20° C., which gave only 0.28% water/min.

TABLE 3

| DRYING TEST RESULTS | | | | |
|---|---|---|---|---|
| Test Type and Temperature | Drying Rate (% Water Removed/min) | Drying Rate Improvement vs. Control (%) | Drying Time to 5% Moisture Retained (mins) | Drying Time to 5% Moisture Retained Improvement vs. Control (%) |
| No Particles/20° C. (Control) | 0.19 | N/A | 289 | N/A |
| Particles/20° C. | 0.28 | 47 | 196 | 32 |
| Particles 60° C./ Dryer 20° C. | 0.48 | 153 | 115 | 60 |

Hence, the heated particles clearly improve the drying efficiency as might be anticipated; perhaps less expected, however, is the extent of the improvement—some 71%. Clearly therefore, this is an alternative drying approach which also has merit, but the key here will be the energy consumed in heating the particles vs. the same energy used to heat the air in the dryer. The low specific heat capacity of the polymeric particles in particular should, however, prove advantageous in this regard. The obvious advantage of such particle drying is the ability to transfer heat between drying cycles—something which is inherently lost with air heating.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith.

All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A method for the drying of a wet substrate, said method comprising treating the substrate with a solid particulate material at ambient or elevated temperature, said treatment being carried out in an apparatus comprising a drum comprising perforated side walls, wherein said drum comprising perforated side walls is rotated so as to facilitate increased mechanical action between said substrate and said solid particulate material, wherein said method additionally comprises separation of the solid particulate material from the dried substrate on completion of the drying process and recovery of said solid particulate material for re-use in subsequent drying procedures, and wherein the drying method is carried out at a temperature of between 5° C. and 120° C.

2. The method as claimed in claim 1, wherein said drum comprising perforated side walls comprises a rotatably mounted cylindrical cage having a capacity of between 5 and 50 liters for each kg of substrate.

3. The method as claimed in claim 1, wherein said drying process and said separation of the solid particulate material from the dried substrate are carried out by rotation of said drum comprising perforated side walls at a speed which generates G forces in the range of from 0.05 to 0.99 G.

4. The method as claimed in claim 1, wherein said solid particulate material comprises a multiplicity of particles which are added at a particle to fabric addition level of 0.1:1-10:1 by mass.

5. The method as claimed in claim 1, wherein said solid particulate material comprises a multiplicity of particles, wherein said particles comprise solid or hollow particles.

6. The method as claimed in claim 1, wherein said solid particulate material comprises mixtures of polymeric and non-polymeric particles and the ratio of said polymeric particles to said non-polymeric particles is selected from the group consisting of from 99.9%:0.1% to 0.1%:99.9% w/w; from 95.0%:5.0% to 5.0%:95.0% w/w and from 80.0%:20.0% to 20.0%:80.0% w/w.

7. The method as claimed in claim 1, wherein said solid particulate material comprises a multiplicity of particles and said particles comprise polymeric particles or mixtures of polymeric and non-polymeric particles, wherein said polymeric particles have an average density in the range of 0.5 to 2.5 g/cm$^3$; said non-polymeric particles have an average density of from 3.5 to 12.0 g/cm$^3$; and the average volume of said polymeric and non-polymeric particles is in the range of from 5 to 275 mm$^3$.

8. The method as claimed in claim 1, wherein said solid particulate material comprises a multiplicity of particles, wherein said particles are selected from the group consisting of: cylindrical particles of oval cross section and having a major cross section axis length in the range of from 2.0-6.0 mm and a minor cross section axis length in the range of from 1.3-5.0 mm and a length of from 1.5-6.0 mm; cylindrical particles of circular cross section having a cross section diameter in the range of from 1.3-6.0 mm and a length of from 1.5-6.0 mm; non-perfect spherical particles having a diameter in the range of from 2.0-8.0 mm; and perfect spheres having a diameter in the range of from 2.0-8.0 mm.

9. The method as claimed in claim 1, wherein said solid particulate material comprises a multiplicity of particles and said particles comprise polymeric particles, wherein at least one of the following conditions applies:

a) said polymeric particles comprise foamed polymeric materials or unfoamed polymeric materials; and/or
b) said polymeric particles comprise linear polymeric materials or crosslinked polymeric materials; and/or
c) mixtures thereof.

10. The method as claimed in claim 1, wherein said solid particulate material comprises a multiplicity of particles and said particles comprise polymeric particles, wherein said polymeric particles comprise beads fabricated from materials selected from the group consisting of polyalkenes, polyamides, polyesters, and polyurethanes, wherein said polyamides comprises Nylon 6 or Nylon 6,6, and wherein said polyesters comprises polyethylene terephthalate or polybutylene terephthalate.

11. The method as claimed in claim 1, wherein said solid particulate material comprises a multiplicity of particles and said particles comprise non-polymeric particles or mixtures of polymeric and non-polymeric particles, wherein said non-polymeric particles are fabricated from a material selected from the group consisting of glass, silica, stone, wood, metal or ceramic, wherein said metal is selected from the group consisting of zinc, titanium, chromium, manganese, iron, cobalt, nickel, copper, tungsten, aluminium, tin, lead and metallic alloys thereof, and said ceramic is selected from the group consisting of alumina, zirconia, tungsten carbide, silicon carbide and silicon nitride.

12. The method as claimed in claim 1, wherein said solid particulate material comprises a multiplicity of particles and said particles comprise non-polymeric particles, wherein said non-polymeric particles comprise coated non-polymeric particles, which comprise a non-polymeric core material and a shell comprising a coating of a polymeric material, wherein the core comprises a steel core and said shell comprises a coating of nylon.

13. The method as claimed in claim 1, wherein said temperature is attained by an air heater, a recirculating fan, or said solid particulate material retaining heat from a previous drying cycle.

14. The method as claimed in claim 2, wherein said apparatus comprises housing and access means, allowing access to the interior of said cylindrical cage, wherein said housing comprises a first chamber and a second chamber and said rotatably mounted cylindrical cage is mounted in said first chamber, wherein said second chamber is located adjacent to said cylindrical cage, and wherein said apparatus additionally comprises recirculation means and delivery means.

15. The method as claimed in claim 14, wherein said apparatus additionally comprises pumping means, and wherein up to 60% of the surface area of said perforated side walls comprises perforations, and said perforations comprise holes having a diameter of no greater than 25.0 mm.

16. The method as claimed in claim 14, wherein said access means comprises a hinged door mounted in the housing which may be opened to allow access to the inside of the cylindrical cage.

17. The method as claimed in claim 2, wherein said apparatus comprises circulation means, adapted to promote circulation of said solid particulate material, wherein said circulation means comprises a multiplicity of spaced apart elongated protrusions affixed essentially perpendicularly to the inner surface of the cylindrical side walls of said rotatably mounted cylindrical cage.

18. The method as claimed in claim 2, wherein said rotatably mounted cylindrical cage comprises a 74 cm diameter cage and the speeds of rotation are in the range of 10-49 rpm.

19. The method as claimed in claim 1, wherein said apparatus comprises:

housing means, having:

a first upper chamber having mounted therein a rotatably mounted cylindrical cage, and a second lower chamber located beneath said rotatably mounted cylindrical cage;

recirculation means;

access means;

pumping means; and delivery means, wherein said rotatably mounted cylindrical cage comprises said drum comprising perforated side walls, wherein up to 60% of the surface area of said side walls comprises perforations, and said perforations comprise holes having a diameter of no greater than 25.0 mm.

20. The method as claimed in claim 1, wherein the method is used for small or large scale batchwise processes.

21. The method as claimed in claim 1, wherein said solid particulate material comprises a multiplicity of particles, optionally wherein said particles comprise polymeric particles, non-polymeric particles, or mixtures of polymeric and non-polymeric particles.

22. The method as claimed in claim 1, wherein said solid particulate material comprises particles that are elliptical, cylindrical, spherical, or cuboid in shape.

23. The method as claimed in claim 1, wherein said substrate is a textile fabric.

* * * * *